United States Patent [19]

Matas-Gabalda

[11] 4,022,390

[45] May 10, 1977

[54] DEVICE FOR YARN SPOOLING

[75] Inventor: Carlos Matas-Gabalda, Granges-les-Valences, France

[73] Assignee: Ateliers de Constructions Bourgeas-Fourgeirol, Valence, France

[22] Filed: Sept. 16, 1975

[21] Appl. No.: 613,886

[30] Foreign Application Priority Data

Sept. 16, 1974 France ..... 74.31300

[52] U.S. Cl. ..... 242/18 DD; 242/129.51

[51] Int. Cl.[2] ..... B65H 54/42; B65H 75/02

[58] Field of Search ..... 242/18 DD, 129.51, 68.4, 242/65, 66

[56] References Cited

UNITED STATES PATENTS

| | | | |
|---|---|---|---|
| 2,197,747 | 4/1940 | Naumann | 242/18 DD |
| 2,651,479 | 9/1953 | Bauer | 242/129.51 |
| 3,181,804 | 5/1965 | Mullers et al. | 242/18 DD |
| 3,241,778 | 3/1966 | Bourgeas | 242/18 DD |
| 3,338,528 | 8/1967 | Eppendahl | 242/18 DD |
| 3,363,850 | 1/1968 | Lingerfelt | 242/18 DD |
| 3,661,334 | 5/1972 | Graf | 242/18 DD |
| 3,672,584 | 6/1972 | Macedo et al. | 242/18 DD X |
| 3,861,606 | 1/1975 | Loquineau et al. | 242/18 DD |
| 3,934,830 | 1/1976 | Grau | 242/18 DD |

FOREIGN PATENTS OR APPLICATIONS

| | | | |
|---|---|---|---|
| 121,319 | 12/1966 | Czechoslovakia | 242/18 DD |
| 1,438,590 | 4/1966 | France | 242/18 DD |
| 815,649 | 7/1959 | United Kingdom | 242/18 DD |
| 898,038 | 6/1962 | United Kingdom | 242/18 DD |
| 985,263 | 3/1965 | United Kingdom | 242/18 DD |
| 1,055,513 | 1/1967 | United Kingdom | 242/18 DD |

*Primary Examiner*—Stanley N. Gilreath
*Attorney, Agent, or Firm*—Arnold, White & Durkee

[57] ABSTRACT

An apparatus for winding up yarn on a spool having a spool rotatably carrier by a spool holder, a frictional drive member in contact with the spool, a spring for centering the spool in the spool holder, a pressure compensator for altering the pressure between the spool and the frictional drive member as a bobbin is wound on the spool, and a shock absorber for controlling the displacement of the spool holder is disclosed.

8 Claims, 4 Drawing Figures

DEVICE FOR YARN SPOOLING

BACKGROUND OF THE INVENTION

The present invention relates to a device for winding up a textile yarn onto a wind-up support or spool of appropriate shape (cylindrical, conical and the like) which rests against a drive cylinder.

It is well known to wind up a yarn on a tubular wind-up support or spool. Essentially two types of devices for gripping the wind-up support are known.

The first type of known wind-up spool gripping device consists of a mandrel which passes through the spool over its entire length and possesses clamping elements which exert radial forces so as to immobilize or engage the spool on the mandrel. It has been found that an overhanging mounting on a pivot arm facilitates positioning and removal of the wind-up spool. However, this first type of arrangement is very expensive to produce in the case of such overhanging mounting on a pivoting arm.

The second type of known wind-up spool gripping device consists of a pair of rotating and coaxial gripping cheek-plates, each of which acts on one end of the tubular spool. These cheek-plates are mounted by means of bearings at the end of a pivotable stirrup. This stirrup is formed by two arms with parallel axes. One of the arms is articulated so as to allow the disengagement and engagement of the wind-up spool, which, thus gripped between the arms, is kept resting against the cheek-plates. The wind-up support or spool is frictionally driven and caused to rotate by means of a drive motor cylinder.

In order to center the spool between the two cheek-plates, the latter are equipped with conventional appropriate centering devices.

In the course of winding-up, it is necessary for the spool, and hence for the bobbin being formed, to be held so as to exert a constant and uniform pressure against the drive cylinder.

As a result of the speed of rotation of the drive cylinder and hence of the spool, the bobbin being formed has a tendency to bounce. This bouncing often causes the formation of a fault on the bobbin, which is known as "facetting", and which, inter alia, causes poor subsequent unwinding of the bobbin and occasionally a break, and premature wear of the mechanical assembly.

Essentially two types of known shock-absorption techniques are used in order to overcome facetting and related problems and disadvantages. The first, called "braking", consists either of friction discs mounted on the body of the stirrup or of hydraulic equipment.

The second type of shock-absorption is called "anti-return". Essentially "anti-return" consists of preventing the bouncing bobbin from falling back on the drive cylinder and does so by means of an anti-return device. For example, an anti-return device may comprise an inclined disc or truncated cone slidable over a rod connected to the framework. This inclined disc or cone has a tendency to reduce the oscillation of the assembly. In practice, this device is complex and costly.

It is also important to control the density of the turns produced in the course of winding-up in order to keep the density as constant as possible. To do this, it is necessary that the pressure of the spool and of the bobbin being formed against the pilot roller be substantially constant. Since, at the start of the winding-up operation, the pressure is low or even zero, a positive pressure is created artificially. This positive pressure diminishes in proportion to the increase in size of the bobbin. When the bobbin reaches a certain diameter, this artificial pressure becomes negative. Here again, in practice, two solutions for compensating the pressure load are used. The first solution consists of a cam and spring system mounted on the body of the stirrup and a roller mounted on the framework. The action of the roller on the cam causes the stirrup to either press down or lift up and thus produces the desired compensation. This solution is generally satisfactory.

The second solution consists of connecting the stirrup by means of a spring to a pivotal axle parallel to the stirrup axle. If the point of attachment is in a straight line with the pivotal axles, the spring, stretched to the maximum, has no effect on the pressure of the coil on the drive cylinder. Before this alignment is reached, its action is positive so as to increase the contact pressure, and after this alignment, it is negative. This device is not very versatile and futhermore is complex to construct in practice.

Leaving out of account the fact that the units which fulfill the functions of shock-absorption, of pressure compensation and of centering are separate, the current winding-up devices are thus complex and delicate.

This is therefore a general object of the present invention to overcome these disadvantages of known devices.

It is a more particular object of the present invention to provide a novel winding-up apparatus having a stirrup which simultaneously fulfills the three functions of centering, pressure compensation and shock-absorption.

It is another object of the present invention to provide a novel winding-up apparatus which is capable of simultaneously controlling the position of the winding-up apparatus, the pressure on the bobbin of a drive roller and the shock on the thread or yarn forming the bobbin which apparatus is simple, economical and strong in construction.

In preferred form an apparatus according to the present invention for winding-up a yarn on a tubular support or spool caused to rotate by tangential contact with a motor drive cylinder comprises a stirrup formed by two arms pivoting about an axle which is firmly fixed to a framework of a machine. These arms have at their free ends two cheek-plates for gripping the support or spool. One of the arms is fixed and the other arm is articulated. A body portion of the stirrup is provided in order to connect the two arms to one another. The body portion is fixedly attached to the fixed arm and is yieldingly attached to the articulated arm.

There is provided a spring mounted on the fixed pivotal axle of the stirrup. This spring presses, on a first side, on a flexible bearing mounted on the same axle and connected to an end of the movable arm.

This spring presses, on the other side, on a plate, one end of which rests on the body of the stirrup while the opposite end forms a cam for a roller fixed relative to the pivotal axle.

In an advantageous embodiment, this device may also comprise a flexible bearing mounted on the pivotal axle of the stirrup and connected to the end of the fixed arm.

In preferred form, the flexible bearings are made of an elastomer.

The manner in which the invention can be practiced and the advantages stemming therefrom will appear more clearly from the description of the embodiment which follows which is given by way of explanation and without implying a limitation and is supported by the attached figures, wherein like reference numerals have been given to like elements.

DETAILED DESCRIPTION OF THE DRAWINGS

Figure 1:
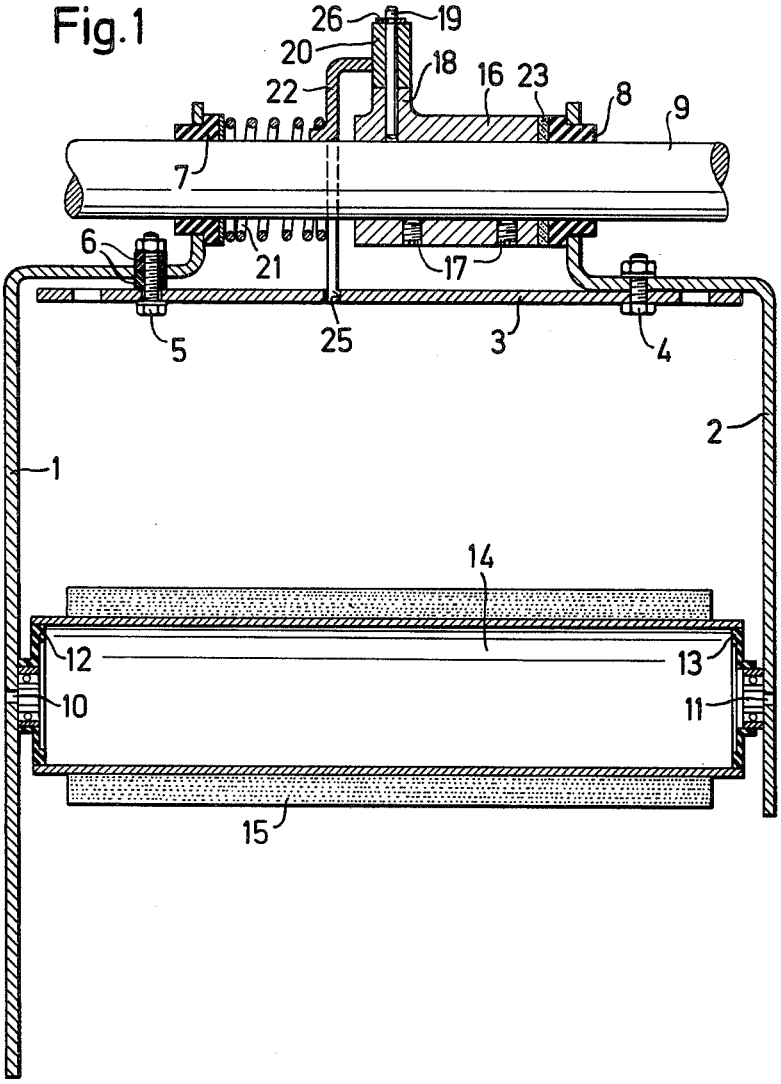
FIG. 1 shows schematically, in horizontal section, a winding-up apparatus according to the invention.

The description of the embodiment which follows relates to a single winding-up station. However, referring to the FIGURES, it will be apparent that the same elements may be repeated for all stations of a single machine, having a common shaft 9, a common shaft for an axle 27, a common shaft for a reciprocating guide 31 and a common shaft for a forming attachment tail device 28.

The apparatus of the present invention comprises a movable arm 1 and a fixed arm 2, for example, made of sheet steel, between which is placed and centered a cylindrical tube or spool 14, for example, of cardboard or of metal, on which a coil or bobbin 15 forms. This tube 14 is placed with its two ends between two centering cheek-plates 12 and 13, for example, made of a plastic such as molded polyamide. The cheek-plates 12 and 13 are rotatably carried by the arms 1 and 2 by a set of bearings 10 and 11. These cheek-plates 12 and 13, known per se, are provided at their ends with a cupel, known per se also, to prevent yarn from winding around and fouling the bearings 10 and 11 after a breakage of the yarn. The free end of the movable arm 1 is significantly extended beyond the centering cheek-plate 12 to provide a handle, to allow an operator to cause this arm to pivot and thereby carry out bobbin-changing operations.

The fixed arm 2 is attached by two bolts 4 or by any other suitable means, e.g., welding and the like, to a body portion 3 of the stirrup. This body portion may also be made of sheet metal. The movable arm 1 is inserted between two small plates 6 of a flexible material, e.g., elastomer, and is fixed to the body portion 3 by means of two bolts 5. These small flexible plates 6 permit an articulation or slight lateral displacement of the movable arm 1 while more or less clamping the arm 1 with the nuts 5. The small plates 6, therefore, provide through compression, a lateral angular adjustment, and also vertical angular adjustment, which is not possible with prior art apparatus.

The ends of the arms 1 and 2 have two coaxial holes, not marked with reference numbers, in which are mounted bearings 7 and 8 respectively which are made of a flexible material e.g., elastomer. The bearings 7 and 8 from shock-absorbers and permit the articulation of the arm-body assembly. These shock-absorbing bearings 7 and 8 are mounted on the axle 9, e.g., 25 millimeters diameter steel, firmly fixed to the framework of the machine and serving as the pivotal axle of the assembly. As noted above, this axle 9 can, as required, be shared by several stations, and even by one entire side of the machine. It may be seen that the stirrup formed by the arms 1 and 2 and the body 3 pivots about the fixed shaft 9. Thus, the shaft 9, although "fixed" with respect to the station or stations, forms the shaft about which the stirrup pivots.

A steel ring 16 is positioned substantially between the two bearings 7 and 8. This ring 16 is fixed on the axle 9 by means of set screws 17. This ring 16 has a boss 18 on which is mounted an axle 19. A roller 20 is rotatably carried by the axle 19 and is held in position by a circlips 26. The bearings 7 and 8 are fixed to the shaft in the sense that the bearings 7 and 8 are not rectilinearly movable and are not slidable relative to the axis of the shaft 9. However, the bearings 7 and 8 are flexible and deformable so that the bearing 8 can create pressure against the shaft 9 through the ring 16 to brake the stirrup. Further, the bearings 7 and 8 are rotatable about the shaft 9.

Figure 2:
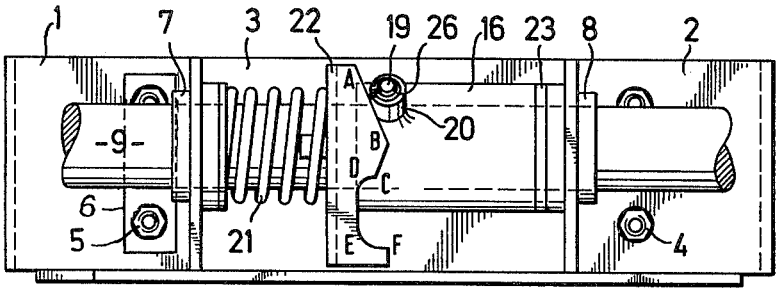
FIG. 2 shows a plan view of the apparatus of FIG. 1.

In the space between the ring 16 and the end of the movable arm 1 there is seated a steel spring 21 which presses firstly against a bearing 7 an secondly against a metal plate 22 (see FIGS. 1 and 2). This plate 22 is bent square and articulates, on one side, on the body 3 against which it rests in a slot 25. On the other side, the plate 22 has a ramp (see FIG. 2) in the shape of a cam, on which rests the roller 20. It is through the cooperation of the roller 20 with the cam-like surface of the plate 22 which functions to provide advantageous compensation as will hereinafter be more fully explained.

In an alternative arrangement, a friction disc 23 may be placed between the end of the ring 16 which rests against the bearing 8, and this bearing 8. However, because of the flexibility of the shock-absorbing bearing 8, this disc 23 can at times be omitted.

In operation, the wind-up spool 14 is kept pressed against a pilot drive roller 24 (FIG. 3), which is caused to rotate by conventional means, such as an electric motor and the like, at a speed which is generally constant. As is known to those skilled in this art, the pilot drive roller 24 is carried on a shaft 27 which may be common to several stations. This roller 24 could be connected to and rotated by a motor, not shown.

The profile of the cam fashioned along a surface or edge of the plate 22, is shown in FIG. 2. This profile is determined in the conventional manner by calculating it so that the pressure of the bobbin 15 being formed on the cylinder 24 shall be constant. As noted, the roller 20 is operable to travel along the cam surface. The position of the roller 20 relative to the cam surface will be related to the amount of bobbin wound upon the tube 14.

In the cam portion A-B of the plate 22 (FIG. 2), the cam moves over the roller or cam follower 20 under the influence of the increase in size of the bobbin 15 and presses the bobbin against the cylinder 24, with this contact pressure progressively decreasing as the bobbin is progressively supported relative to the roller or to the cylinder 24. At C, the cam forms a notch and thus constitutes a stop position for the bobbin, especially for releasing the latter at the end of the operation or for intervening if the yarn should break. The portion C-D corresponds to the release zone, and finally the portion E-F forms the stop at the end of the movement.

Figure 3:
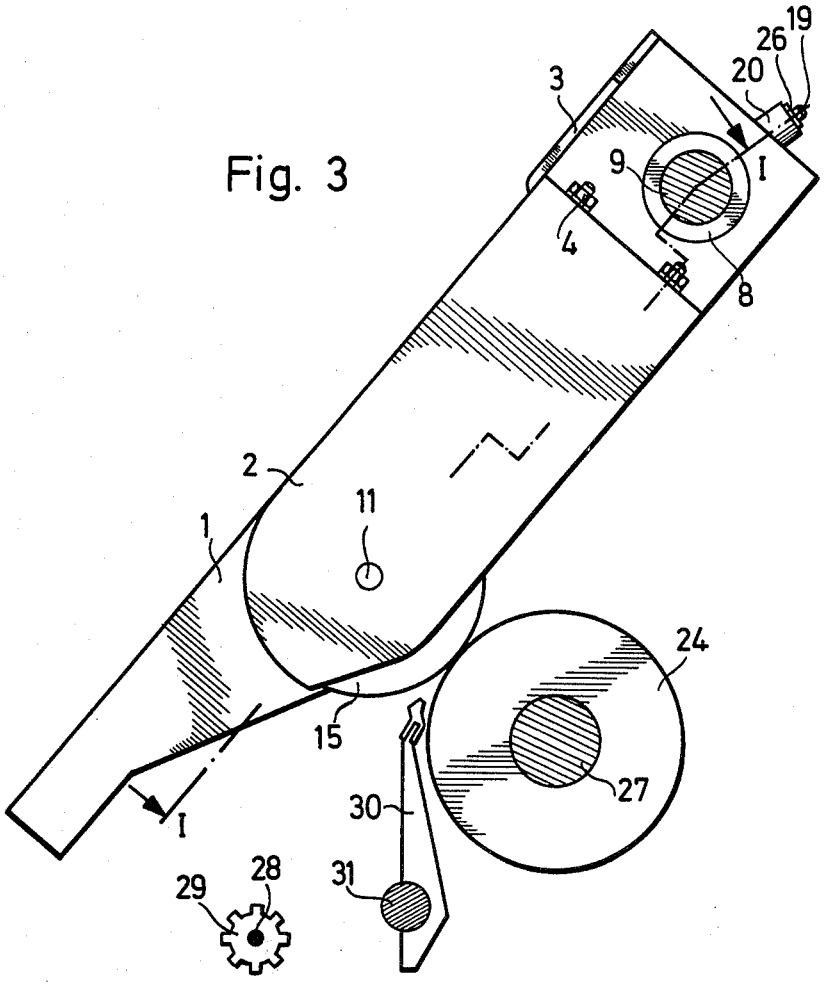
FIG. 3 is a side view of the apparatus of FIG. 1.
Figure 4:
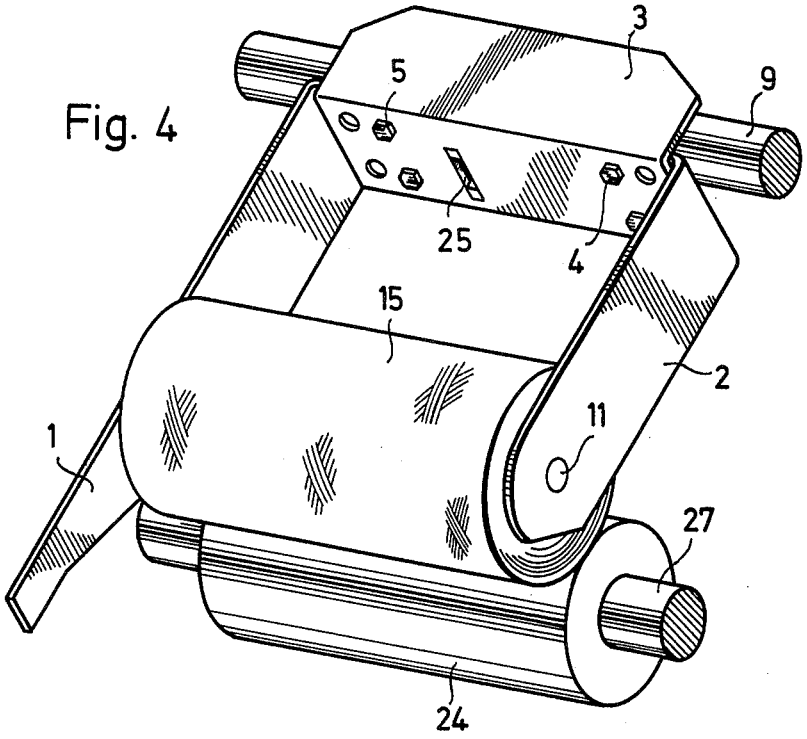
FIG. 4 schematically shows, in perspective, a winding-up apparatus equipped with a stirrup according to the invention.

Under the action of the spring 21, the movable arm 1 presses the spool 14 between the two centering cheek-plates 12 and 13 (centering function). The spool 14 having been placed in position and the formation of the bobbin 15 having been started, throughout under the influence of the same spring 21, the plate 22 in the shape of a cam presses against the roller 20, which thus plays the role of a pressure compensator (compensating function) to regulate the pressure between the drive cylinder 24 and the bobbin 15. Finally, during the wind-up operation, when the rotating bobbin 15, tends to move away from the drive cylinder 24, the spring 21 reacts laterally on the articulated arm 1 to urge the arm 1 towards the relevant end of the spool 14. But, since the articulated arm 1 is still in a blocked position by that spool 14, a reaction force is transmitted to the body 3, and from it to the arm 2 which acts then on the flexible bearing 8. That creates a pressure between the bearing 8 and the steel ring 16, either through the friction disc 23 or directly. Under that pressure, a braking is provided between the fixed part of the steel ring 16 connected to the frame and the stirrup (shock-absorbing function). Thus, it may be appreciated that as the bobbin 15 fills, the stirrup formed by the arms 1 and 2 and body 3 pivots about the "pivotal shaft or axle" 9 in a clockwise direction (FIG. 3). The action of the cam 22 (FIG. 2) provides several functions. The first function is a pressure equalizing function which maintains the pressure on the bobbin constant as the bobbin fills. Also, as the bobbin fills, a second function is performed by the cam 22. The reaction between the cam surface and the roller 20 compresses the spring 21 toward the left in FIGS. 1 and 2. The reaction between the arm 1 in response to the spring 21 would tend to urge the arm 1 in a counterclockwise pivotal direction about the attachment point 6. (FIG. 1). However, since the bobbin 15 is still centered between the arms 1 and 2 of the stirrup, the arm 1 is not able to pivot about the attachment 6 in the counterclockwise direction. Since the arm 1 cannot respond to the compression of the spring 21, that force is transmitted through the body 3 to the arm 2 to force the arm 2 in a counterclockwise direction into the bearing 8. The reaction of the arm 2 with the flexible bearing 8 prevents further pivotal movement of the arm 2 but also creates a pressure between the bearing to cause braking between the bearing 8 and the steel ring 16 (either through the friction disc 23 or directly).

In a variant which is not illustrated, the steel ring 16 can be mounted on a plate with two screws able to incline the axis of the device relating to the drive or pilot cylinder 24. That solution is adapted to accomodate conical bobbins, the axle 9 being individual.

In another variant which is also not illustrated, but adapted to accomodate individual bi-conical bobbins, a lever connects the known pivotable bar called "sinus bar" and the body 3.

The apparatus also comprises means for forming the reserve yarn at the end of the support bobbin including a rotating shaft 28 parallel to 27, equipped with a toothed wheel 29. The device includes also a reciprocating yarn guide 30 fixed on a shaft 31 moving in a reciprocating way.

The use of a spring on the pivotal axis is a means known per se. But, in earlier devices, the function of that spring is quite different. In the U.S. Pat. No. 3,181,804 a spring is used as a shock absorber for the stirrup during the rebound, but it does not provide centering and pressure compensating functions. In the French Pat. No. 834,931, a spring is only used to open the arms of a stirrup.

The described apparatus according to the invention has numerous advantages over prior art devices and solutions. The present invention is essentially characterized by a great simplification in assembly or mounting, low constructional cost (at a cost of one-third compared to known solutions), flexible mounting of the assembly, and hence better resistance to shock and vibration, excellent wear resistance and, finally, great ease of adjustment. Furthermore, the apparatus of this invention makes it possible to align the axle of rotation of the support with the pivotal axle of the assembly without making it necessary to resort to other devices, for example, an eccentric axle on a bearing, as is currently the case in practice.

This device can be used successfully for all yarn winding-up machines having gripping cheek-plates and a stirrup. By way of example, the present invention may be utilized in connection with throwing frames, up-twisters and down-twisters, texturizing machines, especially false twist texturizing machines, machines for carrying out heat treatment of yarns, and bobbin-winding machines, open-end machines, two for one twisting machine.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In an apparatus for winding-up yarn on a tubular support, the tubular support being rotatable by tangential contact with a drive cylinder, a stirrup formed from two arms pivotable about an axle, each of the arms having a cheek-plate for engaging on end of the tubular support, one of the arms being axially fixed with respect to the axle, the other of the arms being axially movable, the improvement comprising:

a body portion of the stirrup fixedly connected to the fixed arm and yieldingly connected to the movable arm;

a first flexible bearing carried by the axle and connected to an end of the fixed arm;

a second flexible bearing carried by the axle and connected to an end of the movable arm;

a ring member mounted on the axle adjacent said first flexible bearing;

a cam follower carried by said ring member;

a plate rotatably carried by the axle, one end of said plate operable to rest in a slot in the body portion of the stirrup and the other end of said plate operable as a cam cooperable with said cam follower; and a spring positioned between said second flexible bearing and said plate to urge said portions of said plate against said cam follower.

2. The apparatus of claim 1 and further comprising a friction disc positioned between said first flexible bearing and said ring member.

3. The apparatus of claim 1 wherein the body portion of the stirrup and the movable arm are yieldably connected by a yieldable connector comprising a pair of flexible plates fixed to the body portion by a bolt.

4. The apparatus of claim 3 wherein said flexible plates are make of an elastomeric material.

5. The apparatus of claim 1 wherein said first and said second bearings are made of an elastomeric material.

6. An apparatus for winding-up yarn on a spool to form a bobbin, said apparatus comprising:

spool holding means for engaging the opposite ends of a spool adaptable for receiving yarn therearound and for rotatably carrying the spool;

drive means for frictionally engaging the spool to rotate the spool to wind yard therearound;

centering means for centering the spool in relation to said spool holding means;

pressure compensating means for controlling a pressure between said drive means and the spool and to reduce the pressure therebetween as a bobbin is wound on the spool; and, shock-absorbing means for limiting a displacement of the spool in a direction away from said drive means as a bobbin is wound on the spool, said shock-absorbing means comprising a flexible bearing at least partially for carrying said spool holding means, a ring relatively fixedly positioned adjacent said flexible bearing, and spring means for urging said spool holding means towards said flexible bearing to increase the friction between said flexible bearing and said ring when said spool holding means is displaced away from said drive means.

7. The apparatus of claim 6 wherein said pressure compensating means comprises a cam movable with said spool holding means as a bobbin is wound on the spool and a cam follower fixed relative to a position of said spool holding means.

8. The apparatus of claim 6 wherein said flexible bearing is fabricated from an elastomeric material.

* * * * *

UNITED STATES PATENT OFFICE

CERTIFICATE OF CORRECTION

Patent No. 4022390 Dated May 10, 1977

Inventor(s) Carlos Matas-Gabalda, Granges-les-Valences, France

It is certified that error appears in the above-identified patent and that said Letters Patent are hereby corrected as shown below:

Line 2, Abstract, delete "carrier" and insert therefor -- carried --;

Column 3, line 62, delete "from" and insert therefor -- form --;

Column 4, line 21, delete "an" and insert therefor -- and --;

Column 5, line 65, delete "834,931" and insert therefor -- 836,931 --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*